US005628484A

United States Patent [19]

Lechuga

[11] Patent Number: 5,628,484

[45] Date of Patent: May 13, 1997

[54] FLOOR MOUNTED WATER BASIN SUPPORT

[76] Inventor: Gabriel Lechuga, 67365 Verona Rd., Cathedral City, Calif. 92234

[21] Appl. No.: 607,132

[22] Filed: Feb. 26, 1996

[51] Int. Cl.[6] ..... A47G 23/02

[52] U.S. Cl. ..... 248/149; 4/594; 4/645; 248/157; 248/188.4

[58] Field of Search ..... 248/149, 151, 248/157, 161, 188, 188.2, 188.4; 108/24, 144; 52/220.8, 127.1, 127.2, 745.05; 4/594, 592, 645, 632

[56] References Cited

U.S. PATENT DOCUMENTS

| | | | |
|---|---|---|---|
| 577,829 | 2/1897 | Brown | 248/151 X |
| 620,393 | 2/1899 | Whitton | 248/151 X |
| 2,509,284 | 5/1950 | Allen | 248/149 |
| 3,143,087 | 8/1964 | Rodder | 108/144 |
| 3,167,292 | 1/1965 | Meyerowitz | 248/161 |
| 3,488,697 | 1/1970 | Lewandowski et al. | 248/188 |
| 5,096,786 | 3/1992 | Wilkinson et al. | 248/188 X |
| 5,125,646 | 6/1992 | Wilkinson | 248/188.2 X |
| 5,333,423 | 8/1994 | Propst | 248/188 X |

*Primary Examiner*—Ramon O. Ramirez
*Attorney, Agent, or Firm*—Robert J. Schaap

[57] ABSTRACT

A water basin floor mounted support for holding a water basin, such as a floor mounted sink or bathtub in a position where it is to be mounted in the floor of a structure during the building of the structure. The floor mounted support comprises a carrier plate having an enlarged central opening designed to receive plumbing connected to the depending tub portion of the water basin. The water basin also has a peripheral flange which is to be mounted in the floor of the construction. A plurality of height adjustable legs hold support the support plate at a desired elevation and thereby stabilize the water basin during the actual fabrication of the floor, such as the pouring of a concrete floor. In this way, the floor can be literally poured or fabricated around the sink or other water basin such that when the floor is completed, the sink or other water basin is firmly mounted in place. The height of the legs are adjustable so as to accommodate for floors of differing height relative to the ground surface.

23 Claims, 2 Drawing Sheets

FLOOR MOUNTED WATER BASIN SUPPORT

BACKGROUND OF THE INVENTION

1. Field of the Invention

This invention relates in general to certain new and useful improvements in floor mounted water basin supports and more particularly to a water basin support which will hold and stabilize a water basin during the fabrication of the floor around that water basin such that the water basin is mounted in and flush with the surface of the floor when completed.

2. Brief Description of Related Art

In many occasions, water basins, such as sinks, are frequently mounted at a floor level. This is particularly true in restaurants and like institutions involved in the preparation or cleaning of foods items. Moreover, the use of a floor mounted sink is often times mandated by law in certain facilities.

During the construction of a building in which a floor mounted sink is to be employed, it is necessary to hold the sink in a position such that the floor can be fabricated around the sink so that when completed, the sink is permanently mounted within the floor. Frequently, the floor is a poured concrete base and consequently, the sink must be in a position before the actual pouring of the concrete so that when the concrete hardens, the sink will be firmly mounted in position in the floor.

The same problems hold true with regard to other water basins which are to be mounted in a floor. As an example, in some areas it is frequently popular to mount a bathtub at a floor level so as to create a so-called "step-down" bathtub. Here again, there is a need for supporting that bathtub in a position so that plumbing can be connected and the bathtub can be literally mounted within the floor when the fabrication of the latter has been completed.

There is presently no known means which is effective for supporting a floor mounted water basin in a desired position to hold and stabilize that basin during the fabrication of the floor around that basin, so that when the floor is completed, the water basin is fixedly mounted within the floor. Generally, plumbing contractors have attempted to use a make-shift arrangement of relying upon the building of a wooden frame for each installation. Often times, the plumbing contractor would attempt to stack pieces of wood upon one another, as for example, two by four boards on top of one another, and then support the rim forming flange of the sink on the upper-most of those boards to allow the floor to be fabricated around the sink. In this way, it was anticipated that the upper surface of the sink would be flush with the floor when completed.

Each of the aforesaid prior art arrangements to support the water basin were all generally make-shift arrangements and which were constructed at each on site location. Such support arrangements are time consuming to construct and involve expensive skilled labor. Moreover, these make-shift arrangements are often times not sturdy and do not adequately hold and stabilize the sink or other water basin during the pouring of a concrete floor or the fabricating of another type of floor.

OBJECTS OF THE INVENTION

It is, therefore, one of the primary objects of the present invention to provide a floor mounted water basin support which is capable of supporting a water basin in a position where a floor can be constructed around that water basin and which then remains mounted in the floor when completed.

It is another object of the present invention to provide a floor mounted water basin support which can be located at a desired height with respect to a ground surface in order to hold and stabilize a water basin for mounting in a floor to be constructed.

It is a further object of the present invention to provide a floor mounted water basin support of the type stated which is capable of being used with a variety of differing types of water basins to support the same for fixedly mounting in the floor.

It is an additional object of the present invention to provide a floor mounted water basin support of the type stated in which the height thereof can be adjustable so as to support a water basin at a desired height with respect to a floor to be constructed.

It is also an object of the present invention to provide a floor mounted water basin support of the type stated which can be constructed at a relatively low cost and which is highly reliable in operation.

With the above and other objects in view, my invention resides in the novel features of form, construction, arrangement and combination of parts and components presently described and pointed out in the claims.

SUMMARY OF THE INVENTION

The present invention relates in general to a floor mounted water basin support which holds and stabilizes a water basin during the fabrication of a floor in which the basin is to be mounted. In this way, the water basin can be fixedly and permanently mounted in the floor when the fabrication of the latter has been completed.

The water basin support of the present invention is capable of being constructed so as to support floor mounted sinks, floor mounted bathtubs and the like. The essential difference in construction is the fact that the size for floor mounted bathtubs or other types of basins will have differing sizes than supports used for floor mounted sinks. However, with respect to floor mounted sinks, generally all such sinks have a common size, although the sinks and hence the floor level, may be located at different heights with respect to the ground surface.

The floor mounted water basin support of the present invention comprises a support plate typically having a relatively flat upper surface. Means forms an enlarged opening in the support plate to receive the tub portion, that is the depending portion, of the water basin. Typically, each of these water basins are comprised of a tub portion having a continuous side wall and a bottom wall which forms an interior compartment to receive the water and a rim forming flange at the upper end. The bottom wall of the basin is typically provided with a drainage port or a drain pipe.

The bottom wall of the floor mounted water basin will be engaged on the upper surface of the support plate. In addition, where desired, locating pins are provided on the upper surface of the plate to receive and hold the water basin in a fixed and desired position on the upper surface of the support plate. Otherwise, if desired, the tub portion of the water basin could extend through the opening and the rim forming flange of the water basin would be engaged by the upper surface of the support plate.

In each of the embodiments of the invention, a leg means is provided for holding the support plate in a desired position and at a desired elevation above a ground surface. In this way, the floor can be fabricated around and mount the basin in the floor when fabricated. The leg means generally comprises a plurality of legs, and in a preferred embodiment, four such legs are located at the corners of the rectangularly shaped support plate. Moreover, in a preferred embodiment of the invention, these legs are adjustably mounted within the support plate. In this way, the height of the support plate can be varied in accordance with a particular construction. Thus, when the water basin is supported on the water basin support, the floor can be fabricated around the water basin.

The term "fabricated" as used herein, is used in a broad sense to refer to any type of construction of the floor, including the pouring of a concrete floor, the making of a wooden floor, or the like.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention, but it is to be understood that such detailed description is not to be taken in a limiting sense.

BRIEF DESCRIPTION OF THE DRAWINGS

Figure 1:
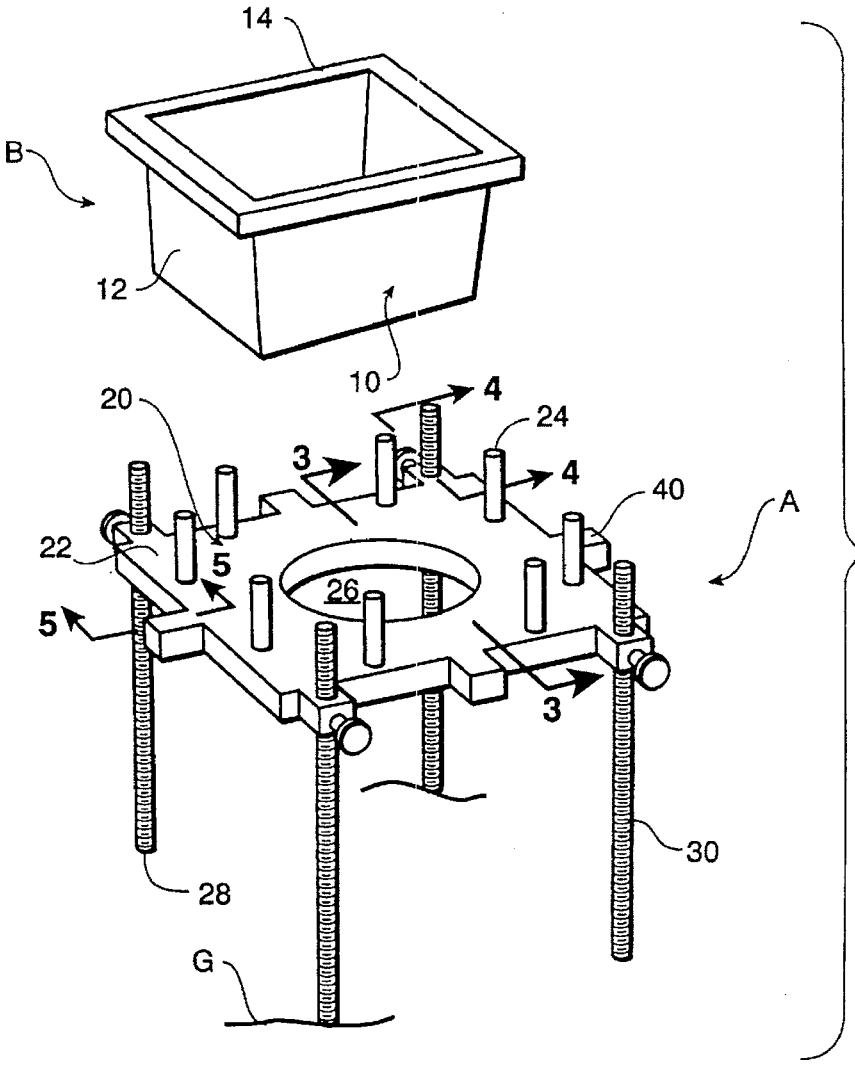
Figure 2:
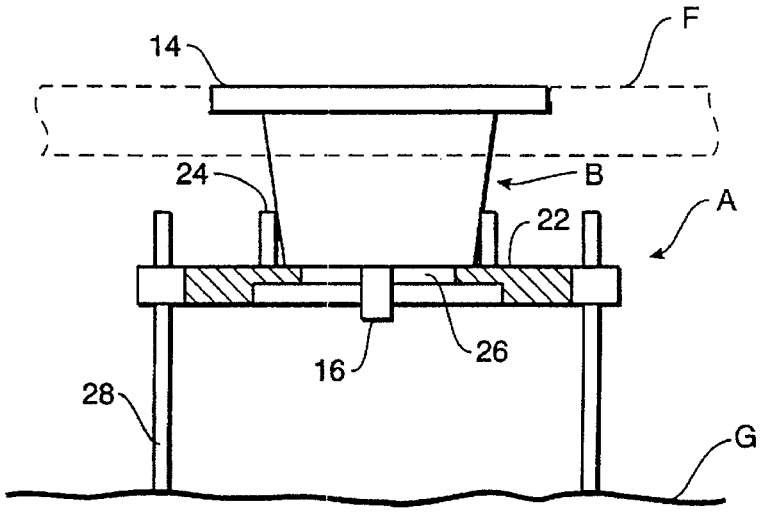
Figure 3:
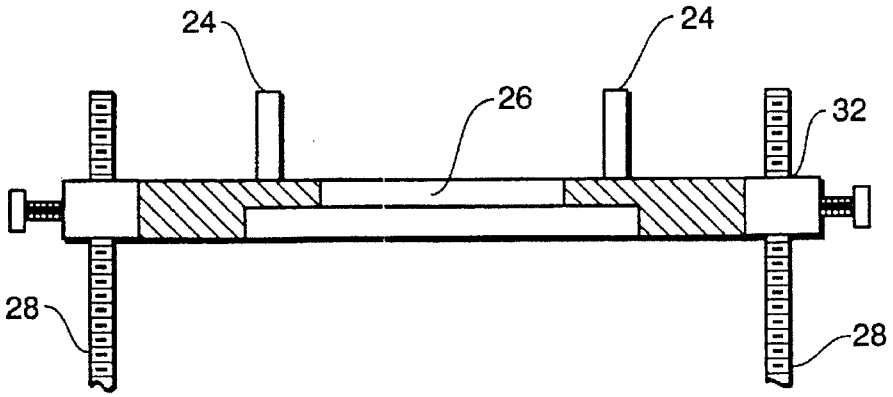
Figure 4:
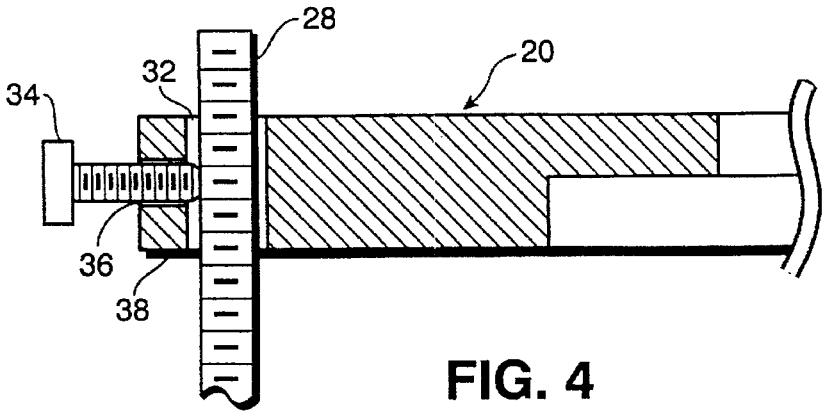
Figure 5:
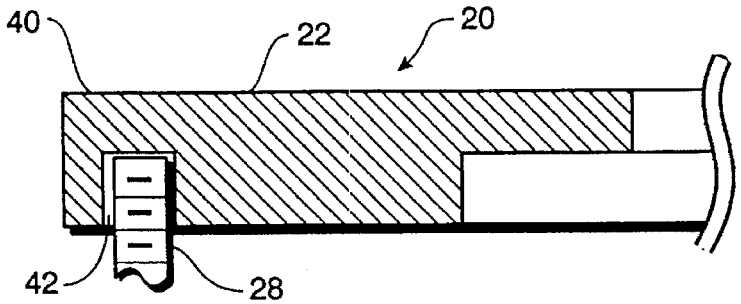
Figure 6:
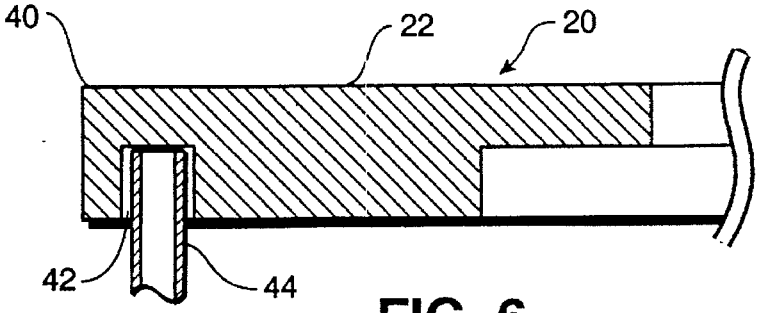

Having thus described the invention in general terms, reference will now be made to the accompanying drawings in which:

FIG. 1 is an exploded perspective view showing a floor mounted water basin support with respect to a water basin and a ground surface;

FIG. 2 is a vertical sectional view of the floor mounted water basin support and showing the supporting of a water basin with respect to a floor to be fabricated;

FIG. 3 is a vertical sectional view taken along line 3—3 of FIG. 1;

FIG. 4 is an enlarged fragmentary vertical sectional view taken along 4—4 of FIG. 1;

FIG. 5 is a fragmentary vertical sectional view similar to FIG. 4 and taken along line 5—5 of FIG. 1; and FIG. 6 is a fragmentary vertical sectional view, similar to FIG. 5, and showing a modified form of floor mounted water basin support constructed in accordance with and embodying the present invention.

DETAILED DESCRIPTION OF A PREFERRED EMBODIMENT

Referring now in more detail and by reference characters to the drawings which illustrate a preferred embodiment of the present invention, A designates a water basin support which is used on and with respect to a ground surface G and a conventional water basin B. The ground surface G is typically a dirt surface or otherwise a concrete foundation which may have been laid for the construction of a building on such foundation.

The water basin B in the embodiment of the invention as illustrated herein is a floor mounted sink. Each of the floor mounted sinks are conventionally provided with a depending tub portion 10 having a continuous side wall 12 and an upper rim forming flange 14. Typically, when the water basin B is mounted within a floor F, as shown in FIG. 2, the rim forming flange 14 is formed within the floor F. In the case of a concrete floor, the floor is poured on forms while the sink is in a position on the water basin support of the invention. In this way, the upper surface of the rim forming flange 14 thereby becomes flush with the upper surface of the floor F, also as best shown in FIG. 2 of the drawings.

The water basin B is typically provided with one or more drains 16, as shown in FIG. 2. This one or more drains 16 would then be connected to a suitable drain line (not shown). If desired, water inlet lines could be connected to the water basin B.

The water basin support A of the present invention generally comprises a support plate 20 having a relatively flat upper surface 22. In this way, the bottom wall of the basin B is capable of being disposed on this flat upper surface 22. Generally, the tub 12 of each of these sinks have a constant size. Accordingly, the upper surface of the support plate 22 is provided with a plurality of locating pins 24 located around a central opening 26. In this way, the position of the tub 10 of the basin B is located and effectively "indexed" with respect to the opening 26.

The support plate 20 is supported on a plurality of legs 28 (four as shown) and which have their lower ends engaged on the ground surface G. These legs 28 all have threaded exterior surfaces 30 and which are received in internally threaded bores or apertures 32 formed in the support plate, as best shown in FIG. 3 of the drawings. In this way, by rotating the legs 28 within the apertures 32, the height of the plate 20 can be adjusted relative to the ground surface G.

It should also be understood in accordance with the present invention, that the opening 26 could be sized with sufficient dimension so that the tub could extend through the opening 26, if desired, and the water basin B supported on its upper rim forming flange 14 on the upper surface 22 or otherwise on the pins 24. In this case, the support plate 20 would also be located close to the upper surface of the floor F which is to be fabricated.

FIG. 4 illustrates an embodiment of the invention in which the legs 28 do not have to be threaded in the apertures 32 in the support plate 20. In this embodiment of FIG. 4, the legs 28 are fixedly held in a desired position in the apertures 32 by a means of releasable locking thumb screws 34. In this case, the thumb screws 34 extend through horizontally located bores 36 formed in protrusions 38 on the plate and engage the legs 28 in the manner as best shown in FIG. 4. Thus, when the thumb screw which is threadedly received in the bore 36 is rotated in one direction, it will release a locking engagement with the leg 28 and when rotated in an opposite direction, such as a clockwise direction, it will engage and tightly hold the support plate 20 in a fixed position relative to the leg.

The support plate 20 of the present invention is provided with a plurality of eight such protrusions 38 which are effectively located at the corners of each of the four peripheral walls of the plate 20. Moreover, intermediate protrusions 40 are also formed on each of these plates (between those at the ends of such sides of the plate) and have blind holes or apertures 42 which do not open at the upper surface of the plate. In other words, capped apertures 42 are formed. In this way, the upper end of the leg 28 will engage the underside of the upper surface 22 and thereby retentively hold the support plate 20 in a desired fixed position. This arrangement is desirable where legs 28 projecting through the upper surface of the support plate is not required and may desirably be avoided to reduce any potential injury to the plumbing contractor.

FIG. 6 shows an embodiment of the invention which uses a so-called "blind aperture 42" similar to that illustrated in FIG. 5. However, in this case, the intermediate protrusions 40 is designed to receive the upper end of an electrical current carrying conduit 44. These conduits are typically hollow, as shown in FIG. 6, although in this case they are not used with any electrical wire.

The floor mounted water basin support of the present invention is highly effective in supporting a water basin in the manner as previously described. Moreover, it can be constructed at a relatively low unit cost. The support plate 20 can be conveniently molded from any of a number of conventional moldable plastics, such as polyethylene, polypropylene, polystyrene, or the like. Moreover, if desired, it can be stamped or even forged from steel or otherwise fabricated from other metals. Moreover, the plate can also be formed of a reinforced plastic composite material for additional strength, if desired.

The legs 28 may actually be threaded rods or straight non-threaded rods where thumb screws are used to lock the legs in a fixed position in the support plate. Moreover, they can also be steel threaded reinforcing bar stock. Thus, the entire unit can be made at a relatively low cost. In this way, when the floor is fabricated, the unit can actually remain in its position on the ground surface G and in effect, becomes a disposable item.

Thus, there has been illustrated and described a unique and novel floor mounted water basin support which holds and stabilizes a water basin during the fabrication of a floor and in which the basin is to be mounted so that the basin becomes fixedly mounted in the floor when completed. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A floor mounted water basin support which holds and stabilizes a relatively heavy conventional water basin of the type having an enclosing side wall and a bottom wall and a peripheral rim during fabrication of a floor in which the basin is to be mounted so that the basin is mounted in the floor when completed, said water basin support comprising:

a) a support plate;

b) means forming an opening in said support plate to receive a drain portion of the basin while operatively supporting a bottom wall of a basin on the support plate with the rim thereof located above the support plate and to allow for room to connect conventional plumbing pipes or fittings to that basin;

c) leg means for holding said support plate in a desired position and at a desired elevation above a ground surface so that a floor can be fabricated above the plate and around a basin and mount this basin in the floor when fabricated; and d) said support plate being formed of a non-electrically conductive material to preclude a soil from being in electrically conductive communication with the water basin or any plumbing pipes or fittings associated therewith to thereby present corrosive action.

2. The floor mounted water basin support of claim 1 further characterized in that said leg means comprises a plurality of spaced apart legs.

3. The floor mounted water basin support of claim 2 further characterized in that leg adjusting means is associated with said legs to allow the support plate to be located at a desired elevation above the ground surface.

4. The floor mounted water basin support of claim 3 further characterized in that the leg adjusting means associated with said legs is a threaded section on the end of said legs which is received in an aperture on said support plate.

5. The floor mounted water basin support of claim 3 further characterized in that the leg adjusting means associated with said legs comprises apertures in the support plate for each of said legs and locking fasteners which are engagable against the legs to lock and support the legs in a selected position with respect to the support plate.

6. The floor mounted water basin support of claim 3 further characterized in that the leg adjusting means associated with said legs is a threaded section on the end of said legs which is received in an aperture on said support plate.

7. The floor mounted water basin support of claim 1 further characterized in that a plurality of upstanding indexing pegs are located on the upper surface of said support plate for locating a water basin on the support plate in a desired position.

8. The floor mounted water basin support of claim 1 further characterized in that said support plate is formed of a plastic or reinforced composite material to preclude a soil from being in electrically conductive communication with a water basin or any plumbing pipes or fittings associated therewith to thereby present corrosive action.

9. The floor mounted water basin support of claim 1 further characterized in that said plate has a plurality of outwardly extending projections with apertures on the underside of said projections to receive the upper ends of legs.

10. The floor mounted water basin support of claim 9 further characterized in that said plate has a plurality of outwardly projecting elements which have apertures on their underside to receive the upper ends of an electrical conduit.

11. The floor mounted water basin support of claim 1 further characterized in that a plurality of upstanding pegs are located on the upper surface of said support plate for engaging and holding an underside of the basin.

12. The floor mounted water basin support of claim 11 further characterized in that said upstanding pegs are arranged around said opening.

13. The floor mounted water basin support of claim 1 further characterized in that said leg means comprises a plurality of spaced apart legs, and that leg adjusting means is associated with said legs to allow the support plate to be located at a desired elevation above the ground surface.

14. A floor mounted water basin support which holds and stabilizes a relatively heavy conventional water basin of the type having an enclosing side wall and a bottom wall and a peripheral rim during fabrication of a floor in which the basin is to be mounted so that the basin is mounted in the floor when completed, said water basin support comprising:

a) a support plate;

b) means forming an opening in said support plate to receive a drain portion of the basin while operatively supporting a bottom wall of a basin on the support plate with the rim thereof located above the support plate to allow for room to connect conventional plumbing pipes or fittings to that basin;

c) leg means for holding said support plate in a desired position and at a desired elevation above a ground surface so that a floor can be fabricated above the plate and around a basin and mount this basin in the floor when fabricated; and d) a plurality of upstanding indexing pegs located on the upper surface of said support plate and arranged around said opening for locating a water basin on the support plate in a desired position.

15. The floor mounted water basin support of claim 14 further characterized in that said support plate is formed of a plastic or reinforced composite material to preclude corrosive action of a soil from being in electrically conductive communication with a water basin or any plumbing pipes or fittings associated therewith.

16. A combination of a floor mounted water basin and a water basin support therefor which holds and stabilizes a relatively heavy water basin during fabrication of a floor in which the basin is to be mounted so that the basin is mounted in the floor when completed and the support may remain in its position under the water basin, said combination of water basin and water basin support comprising:

a) a water basin comprising:
   1) an enclosing side wall;
   2) a bottom wall connected to an underside of said enclosing side wall;
   3) a peripheral rim on said enclosing side wall;
   4) a drain portion on said water basin;

b) a water basin support comprising:
   1) a support plate;
   2) means forming an opening in said support plate to receive said drain portion of the basin while operatively supporting the bottom wall of the basin on the support plate with the rim thereof located above the support plate and to allow for room to connect conventional pluumbing pipes or fittings to that basin;

c) leg means for holding said support plate in a desired position and at a desired elevation above a ground surface so that a floor can be fabricated above the plate and around the basin and mount this basin in the floor when fabricated; and d) said support plate being formed of a non-electrically conductive material to preclude a soil from being in electrically conductive communication with the water basin or any plumbing pipes or fittings associated therewith to prevent corrosive action.

17. The combination of claim 16 further characterized in that said support plate is formed of a plastic or reinforced composite material to preclude a soil from being in electrically conductive communication with a water basin or any plumbing pipes or fittings associated therewith to prevent corrosive action.

18. The combination of claim 16 further characterized in that said leg means comprises a plurality of spaced apart legs, and that leg adjusting means is associated with said legs to allow the support plate to be located at a desired elevation above the ground surface.

19. The combination of claim 16 further characterized in that a plurality of upstanding pegs are located on the upper surface of said support plate for engaging and holding an underside of the basin.

20. The combination of claim 16 further characterized in that said upstanding indexing pegs are arranged around said opening on an upper surface of said plate for locating the water basin in a desired position on the plate.

21. A combination of a floor mounted water basin and a water basin support therefor which holds and stabilizes a relatively heavy water basin during fabrication of a floor in which the basin is to be mounted so that the basin is mounted in the floor when completed and the support may remain in its position under the water basin, said combination of water basin and water basin support comprising:

a) a water basin comprising:
   1) an enclosing side wall;
   2) a bottom wall connected to an underside of said enclosing side wall;
   3) a peripheral rim on said enclosing side wall;
   4) a drain portion on said water basin;

b) a water basin support comprising:
   1) a support plate;
   2) means forming an opening in said support plate to receive said drain portion of the basin while operatively supporting the bottom wall of the basin on the support plate with the rim thereof located above the support plate to allow for room to connect conventional plumbing pipes or fittings to that basin;

c) leg means for holding said support plate in a desired position and at a desired elevation above a ground surface so that a floor can be fabricated above the plate and around the basin and mount said this basin in the floor when fabricated; and d) a plurality of upstanding indexing pegs arranged around said opening on an upper surface of said plate for locating the water basin in a desired position on the plate.

22. The combination of claim 21 further characterized in that said support plate is formed of a plastic or reinforced composite material to preclude corrosive action of a soil from being in electrically conductive communication with a water basin or any plumbing pipes or fittings associated therewith.

23. The combination of claim 21 further characterized in that said leg means comprises a plurality of spaced apart legs, and that leg adjusting means is associated with said legs to allow the support plate to be located at a desired elevation above the ground surface.

* * * * *